US010634144B2

(12) United States Patent
Khurram

(10) Patent No.: US 10,634,144 B2
(45) Date of Patent: Apr. 28, 2020

(54) INLETS FOR ROTARY VANE VACUUM PUMP

(71) Applicant: RT Hamilton and Associates Limited, Stoney Creek (CA)

(72) Inventor: Akhtar Khurram, Mississauga (CA)

(73) Assignee: RT Hamilton and Associates Limited, Stoney Creek, Ontario (CA)

( * ) Notice: Subject to any disclaimer, the term of this patent is extended or adjusted under 35 U.S.C. 154(b) by 0 days.

(21) Appl. No.: 16/089,178

(22) PCT Filed: Apr. 1, 2016

(86) PCT No.: PCT/CA2016/050378
§ 371 (c)(1),
(2) Date: Sep. 27, 2018

(87) PCT Pub. No.: WO2017/165950
PCT Pub. Date: Oct. 5, 2017

(65) Prior Publication Data

US 2019/0338780 A1 Nov. 7, 2019

(51) Int. Cl.
*F04C 29/12* (2006.01)
*F04C 18/344* (2006.01)

(52) U.S. Cl.
CPC ..... *F04C 29/12* (2013.01); *F04C 18/344* (2013.01); *F04C 18/3441* (2013.01); *F04C 2250/101* (2013.01)

(58) Field of Classification Search
CPC .. F04C 18/344; F04C 29/12; F04C 2250/101; F04C 18/3441
See application file for complete search history.

(56) References Cited

U.S. PATENT DOCUMENTS 3,226,014 A * 12/1965 Janenkov ..... F04C 18/344 418/13
3,291,384 A * 12/1966 Garland ..... F04C 29/12 418/85
3,437,079 A * 4/1969 Odawara ..... F01C 1/3441 418/111
5,431,552 A * 7/1995 Schuller ..... F04C 29/12 418/15
5,511,525 A * 4/1996 Jirnov ..... F04C 18/3441 418/255

(Continued)

FOREIGN PATENT DOCUMENTS

WO 9920904 A1 4/1999

OTHER PUBLICATIONS

International Search Report; Canadian Intellectual Property Office; International Application No. PCT/CA2016/050378; dated Dec. 12, 2016; 2 pages.

(Continued)

*Primary Examiner* — Mary Davis
(74) *Attorney, Agent, or Firm* — Taft Stettinius & Hollister LLP

(57) ABSTRACT

This invention discloses an improved rotary vane vacuum pump. The vacuum pump includes an enlarged inlet port which is spread over the width and length of the stator in a zig-zagging fashion within which the vanes pass. In one embodiment, the inlet port describes an inverted W shape in the stator and includes appropriately placed ribs to ensure the stator does not deform around the inlet port.

12 Claims, 6 Drawing Sheets

(56) References Cited

U.S. PATENT DOCUMENTS

| | | | | |
|---|---|---|---|---|
| 6,030,191 | A * | 2/2000 | Wood | F04C 15/0049 418/1 |
| 2004/0007201 | A1 | 1/2004 | Al Hawaj | |

OTHER PUBLICATIONS

Written Opinion of the International Searching Authority; Canadian Intellectual Property Office; International Application No. PCT/CA2016/050378; dated Dec. 12, 2016; 3 pages.

* cited by examiner

INLETS FOR ROTARY VANE VACUUM PUMP

CROSS REFERENCE TO RELATED APPLICATIONS

The present application is a U.S. National Phase of International PCT Application No. PCT/CA2016/050378 filed Apr. 1, 2016, the contents of which are incorporated herein by reference in their entirety.

TECHNICAL FIELD

This invention deals with improvements to rotary vane vacuum pumps.

BACKGROUND

Rotary vane pumps are well known as means of creating vacuums. Rotary vane pumps are positive-displacement pumps that function by vanes mounted to a rotor rotating inside of a cavity defined by a stator.

In a preferred embodiment, the rotor is of a smaller radius than the radius of the stator and is eccentrically mounted such that the axis of the rotor is displaced from the axis of the stator leaving the rotor and vanes to turn freely within the stator.

The vanes can be variable length and may be tensioned to maintain contact with the walls as the rotor rotates. If the vanes are not tensioned, centrifugal force developed while the rotor turns will drive the vanes outward maintaining contact with the stator.

Vanes may be made of a durable natural or synthetic material. Kevlar (trademark) is used in a preferred embodiment. The choice of material allows the vanes to be worn down while maintaining a seal with the stator.

Lubricants can be used in the system to ensure a seal between the vanes and the stator. If lubricants are used in vacuum applications, provision must be made to ensure their removal before the gases or fluids being pumped are exhausted from the system. Such filter systems are well known in the art.

Vanes may be mounted radiating from the axis of the rotor. The vanes may also be angled into the direction of the rotor's rotation to create a scoop effect.

Rotary vane pumps have been known since at least 1874. CA3559 issued to Barnes describes a hand-operated rotor with vanes which are said to slide diametrically from rotation. The invention also shows inlet and outlet ports.

When operated in order to generate a vacuum, a rotary vane pump has a number of practical operating parameters. In industrial applications, the vacuum pressure (stated as inches or centimetres of mercury or pounds per square inch) and the amount of air flow (stated as volume per time such as cubic feet per minute) are used as an indication of the pump's capacity.

In certain industrial applications, the size and weight of a rotary vane vacuum pump are important considerations. For example, a rotary vane vacuum pump that will be used in a mobile environment must be sufficiently large for the pumping task at hand yet sufficiently light that the fuel requirement of the ongoing transportation of the pump is reduced.

It is known that in designing rotary vane vacuum pumps an important design consideration is the size and location of the inlet port in relation to the outlet port. (See: Ramprasad and Radha, *On some design aspects of rotary vane pumps*. Vacuum 23:7 page 245) However, until the present invention, no practical proposals has been made how to achieve a suitably sized and disposed inlet port.

Some rotary vacuum pumps have provided for multiple inlet ports. U.S. Pat. No. 2,314,056 to Sobek shows multiple small sized inlet ports disposed along a longer inlet channel thereby achieving a cooling function as the cooler inlet air is circulated around the stator. However, the long distance the air needs to travel likely reduces the increased function that the multiple air inlet ports might have.

Another possibility to increase the amount of inlet air is to increase the size of the inlet port and to provide means that the inlet air will be exposed to the vanes for a longer distance of travel of the vanes. Application DE19853104 to Song suggests the extension of the inlet port in this fashion without actually providing means on how to accomplish this function in practice.

Another possibility to increase the amount of inlet air is to create additional ports. U.S. Pat. No. 7,207,782 to Heaps provides for an additional inlet port. This in turn also requires non return valves and involves more complex inlet geometry and manufacturing to create the additional inlet port in the stator.

Although it is known that the efficiency and throughput of a vacuum pump can be increased by increasing the size of the inlet ports in the body of the stator, a number of different practical problems arise.

One of the practical problems in increasing the size of the inlet ports in the body of the stator is their possible mechanical interaction with the vanes. For example, a port that is elongated in the parallel direction of a vane risks the possibility that as a vane rotates past the port, the vane may become jammed in the port. In order to prevent this from happening, at any given position, the port opening in the stator must represent only a small portion of the width of the vane.

Another practical problem in designing inlet ports is the amount of arc that a vane will travel perpendicular to the rotation of the rotor across the inlet opening. The actual compression of air required in the pump will not begin until the vane passes the last open portion of the opening. Therefore, the total arc length of the port must be considered to ensure that the efficiency of the pump is not adversely affected.

The number of vanes in the rotor can also affect the efficiency of a pump. The minimum number of vanes is two disposed on alternate sides of the rotor. More vanes can be used spaced equally around the rotor. More vanes means a smaller volume of gas will be enclosed and compressed in any individual space formed between the vanes.

The number of vanes will also affect the sizing of the inlet port. The inlet port will normally be sized taking into account how many different voids between vanes will be covered by the inlet port recognizing that compression in any specific void will not take place until that void has passed by the inlet port opening.

Another challenge in designing inlet ports in the stator is to ensure that appropriate mechanical support is provided at appropriate points to maintain the overall structural integrity of the stator. The stator endures many mechanical and thermal stresses. Appropriate supports to maintain the integrity of the stator particularly around the inlet port is appropriate.

SUMMARY OF THE INVENTION

It is an object of this invention to overcome limitations of the prior art by increasing the volume of air that can be provided through the inlet port of a rotary vane vacuum pump.

It is another object of this invention to increase the efficiency of a rotary vane vacuum pump in order to reduce the size and weight of the device for units that are in mobile service.

This patent describes a rotary vane vacuum pump which contains a larger inlet port than known in the prior art.

The inlet port in the stator described herein avoids interaction with the vanes by being generally disposed in a diagonal manner to the orientation of the vanes. In its simplest embodiment, the inlet port in the stator would comprise one diagonal channel of a suitable height, depth and length and in turn the said diagonal channel is connected to a port outside of the stator in order to provide the vacuum for practical purposes.

In order to provide more air flow through the inlet port, another embodiment of the channel in the stator would have the channel change direction at the top of its travel forming an inverted vee.

Even more air flow through the inlet port can be accomplished by having the channel change direction more than once in a "zig zag" fashion along the stator. The total number of connected diagonal channels and the height, depth and length of their disposition are disposed to maximum the air flow through the inlet port without interfering or causing any obstruction with the vanes moving on the rotor within the stator.

When each diagonal channel changes direction, the open distance of the channel is increased. Such a larger opening may interfere with the vanes moving on the rotor within the stator. The potential of a vane catching on the edge of the channel in the stator is more acute when a vane encounters a sharper point in the channel in the direction of travel of the vane. In such cases, a rib can be added perpendicular to the direction of travel of the vane in order to avoid any such catching.

The addition of ribs across the channel in the stator at each point of its change in direction also helps maintain the integrity of the channel in the stator as thermal and mechanical stresses build up.

In considering the size of the overall inlet port channel and its position in the stator, a number of different measurements are useful to consider.

The height of the overall inlet port channel is measured perpendicular to the vanes. The height can be measured in degrees of arc subtended by a vane from the point where it first encounters any part of the said inlet port channel until it last encounters any part of the said channel.

The width of the overall inlet port channel is measured along a vane and at any point in a vane's travel would be the maximum distance along the vane from one side of the opening of the overall inlet port channel to the distal side of the said opening.

The width of the inlet port channel at any given point in the stator is the width of that portion of the said channel measured along a vane travelling by that said point. The width of the channel will change depending on how the channel is shaped at that point. The width is also likely be the widest when the channel changes direction.

BRIEF DESCRIPTION OF THE DRAWINGS

Embodiments of the present invention are explained, by way of example, and with reference to the accompanying drawings. The drawings illustrate only examples of embodiments of this invention and are therefore not to be considered limiting of its scope, as the invention may have other equally effective embodiments.

DETAILED DESCRIPTION

Figure 1:
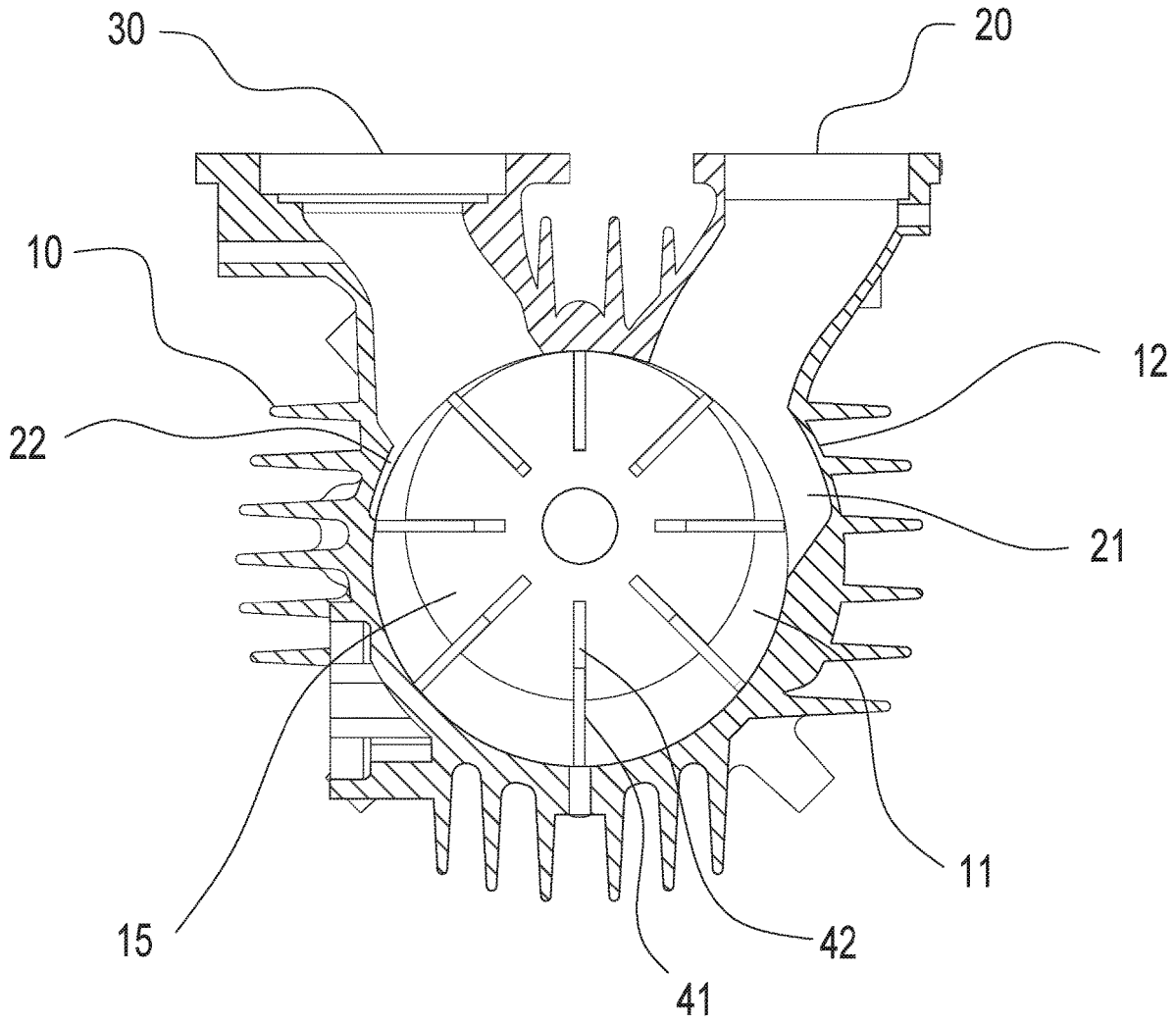
FIG. 1 illustrates a cross-section of a rotary vane vacuum pump according to the invention.

FIG. 1 illustrates a cross-section of a rotary vane vacuum pump 10 according to the invention. The invention has a rotor 15 eccentrically mounted within a stator 12 to create a compression zone 11. Sliding vanes 41 are positioned within the said rotor by suitably displaced spaces 42. An inlet port 20 is connected in the body of the stator to the overall inlet port channel 21. In similar fashion, the outlet port 30 is connected in the body of the said stator to the overall outlet port channel 22.

Figure 2:
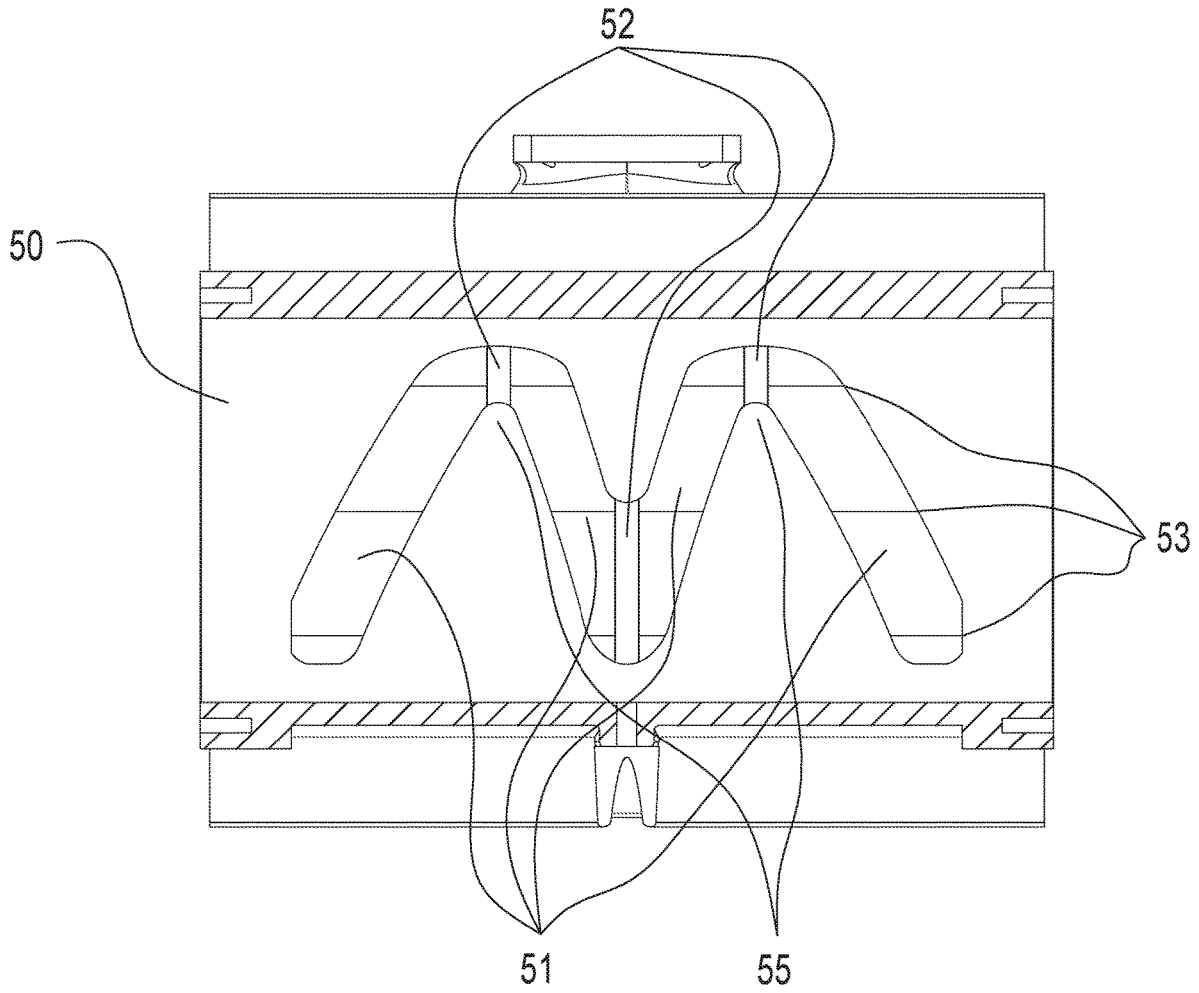
FIG. 2 illustrates the opening in the stator with a preferred embodiment of the invention being an opening in the stator in an inverted W.

FIG. 2 illustrates the opening 51 in the stator 50 with the opening being described as an inverted W. Also shown are ribs 52 which both ensure that the leading edge of the vanes 53 rotating within the said stator do not jam or interact with the acute points 55 in the said opening which could more readily interact with the said vanes and maintain the integrity of the said opening in the said stator.

Figure 3:
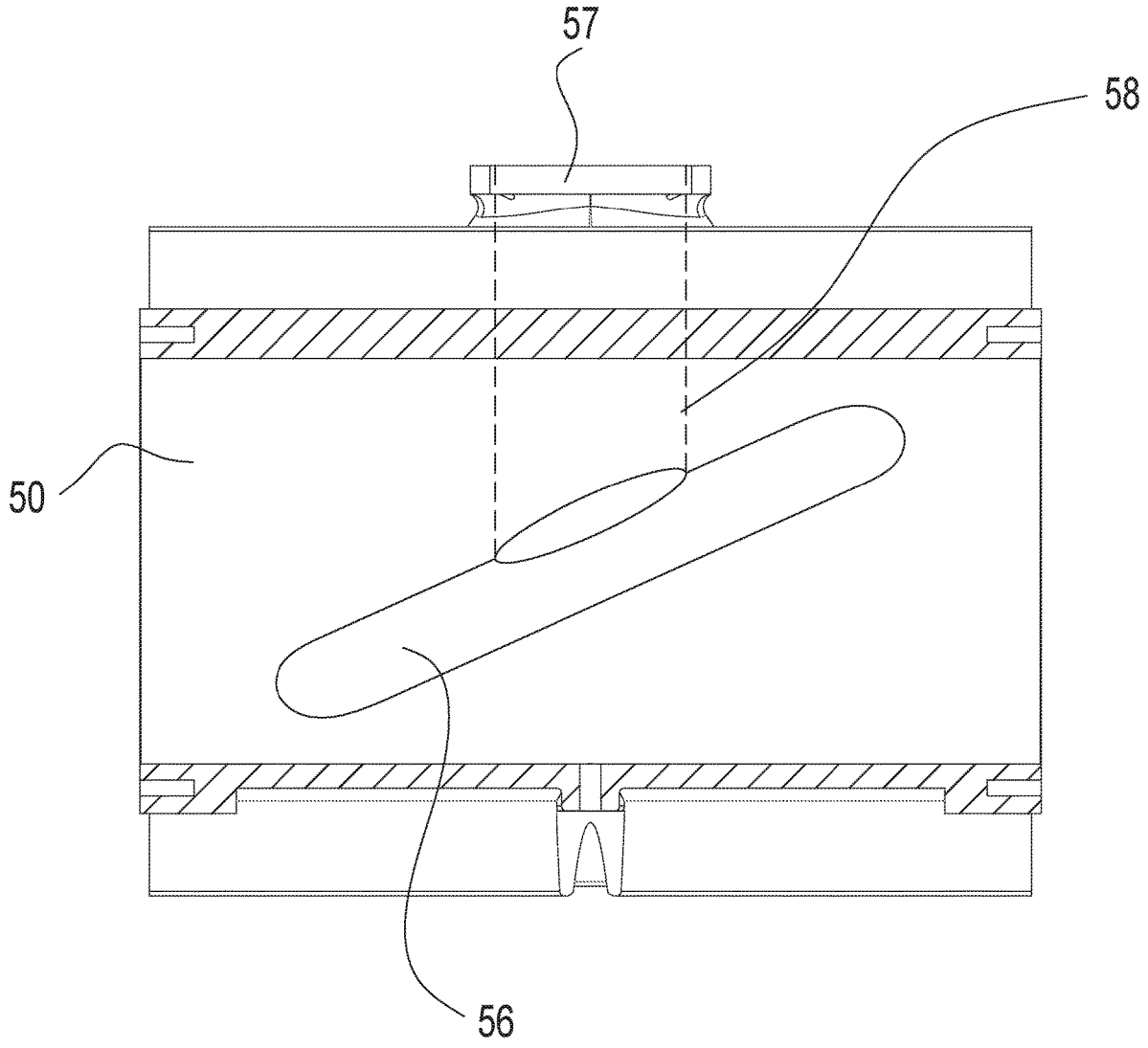
FIG. 3 illustrates an alternate embodiment of the invention being an opening in the stator with a single diagonal.

FIG. 3 illustrates an alternate embodiment of the invention being an opening 56 in the stator with a single diagonal channel. Also shown with phantom lines 58 is how the external intake port can be connected with the said, opening through the stator. It will be noted that in this embodiment, there are no acute points and, accordingly, no robs are required.

Figure 4:
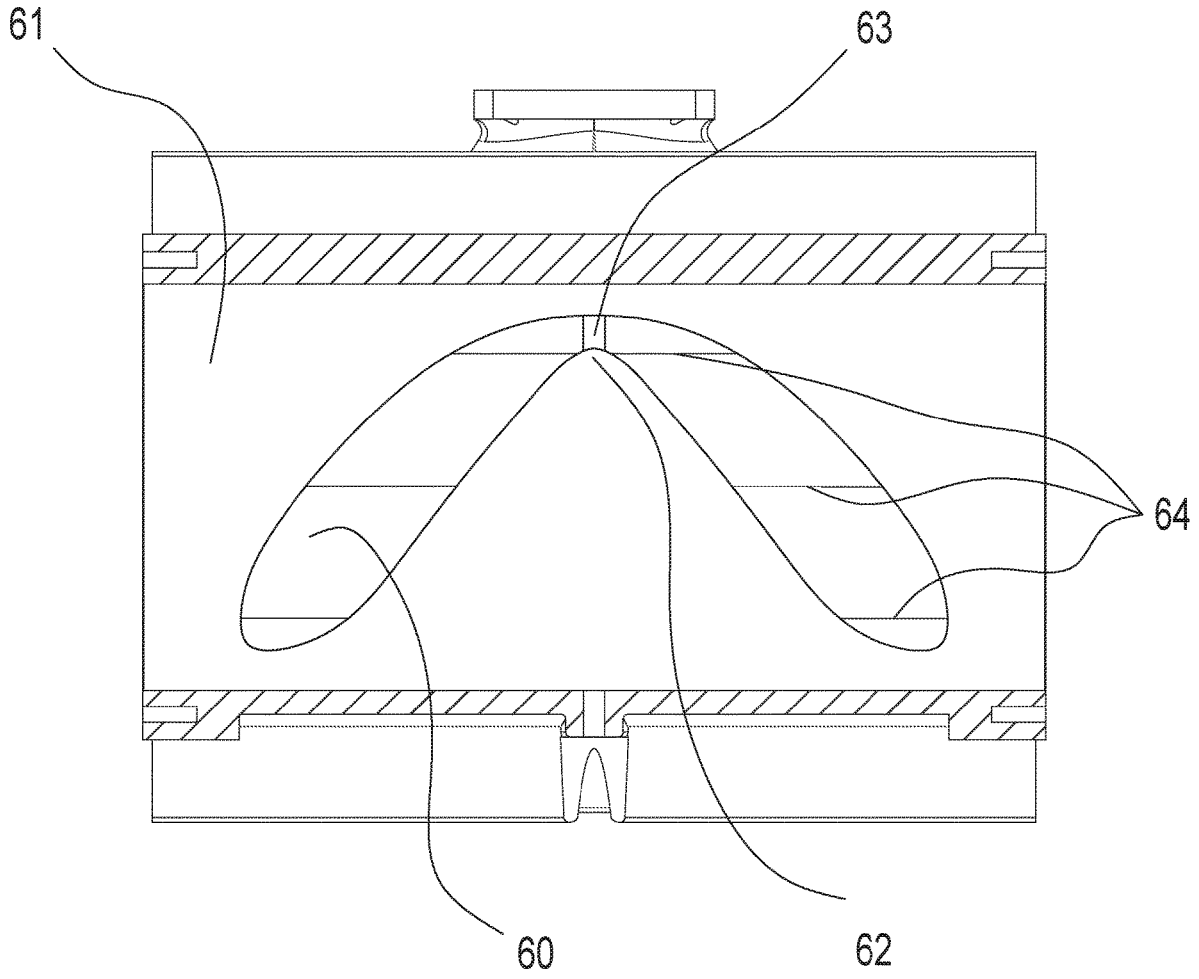
FIG. 4 illustrates an alternate embodiment of the invention being an opening in the stator in an inverted V.

FIG. 4 illustrates an alternate embodiment of the invention being an opening 60 in the stator 61 in an inverted V. A rib 63 prevents the leading edge of the vanes 64 rotating within the said stator from interacting with the acute point 62.

Figure 5:
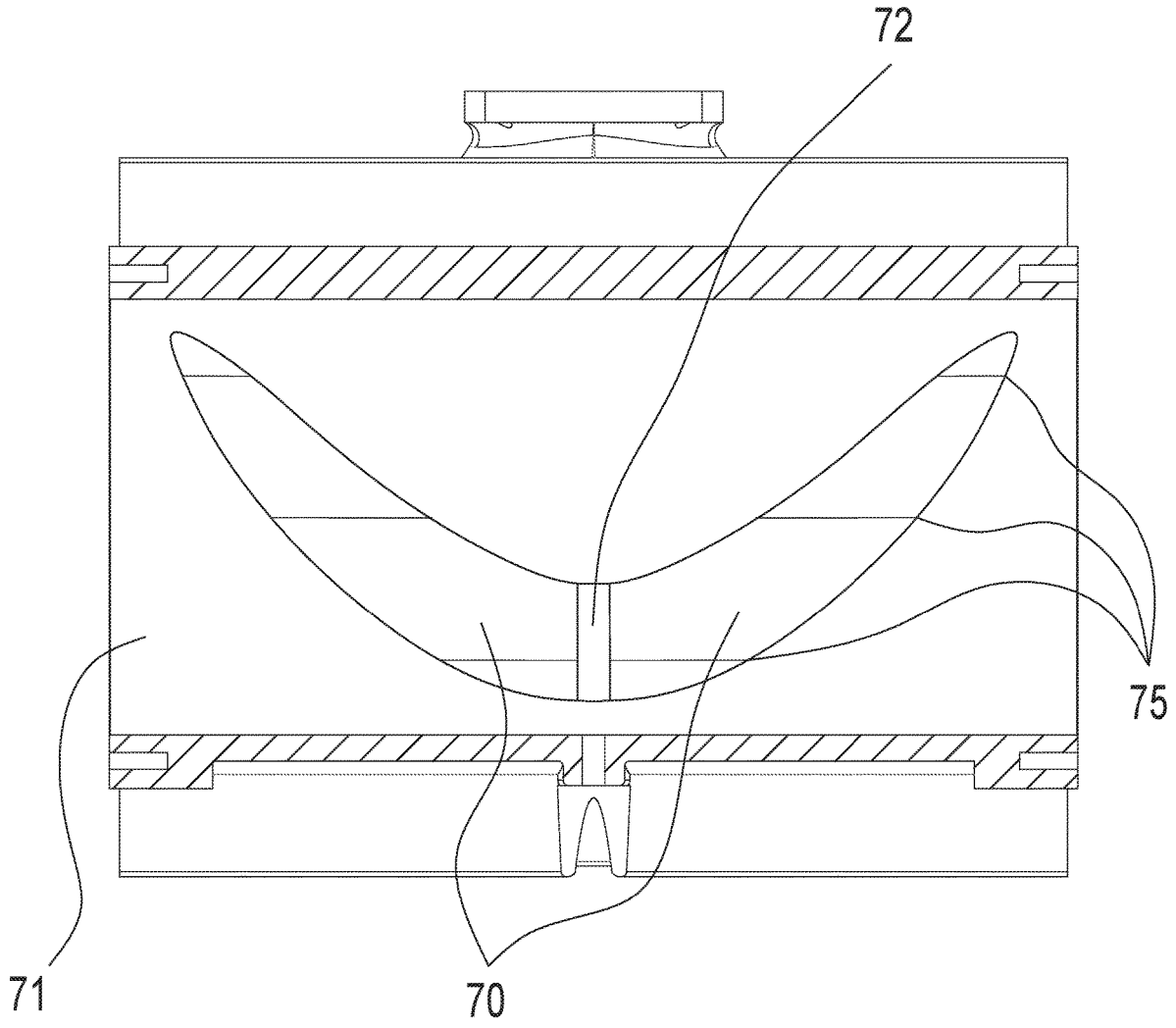
FIG. 5 illustrates an alternate embodiment of the invention being an opening in the stator in an upright V.

FIG. 5 illustrates an alternate embodiment of the invention being an opening 70 in the stator 71 in an upright V. A rib 72 prevents any deformation of the said opening across the said rib. As can be noted, when the leading edge of the vanes 75 rotating with the said stator do not have to interact with an acute point in their direction of travel, the distance across the said rib than when there is such an acute point as in FIG. 4.

Figure 6:
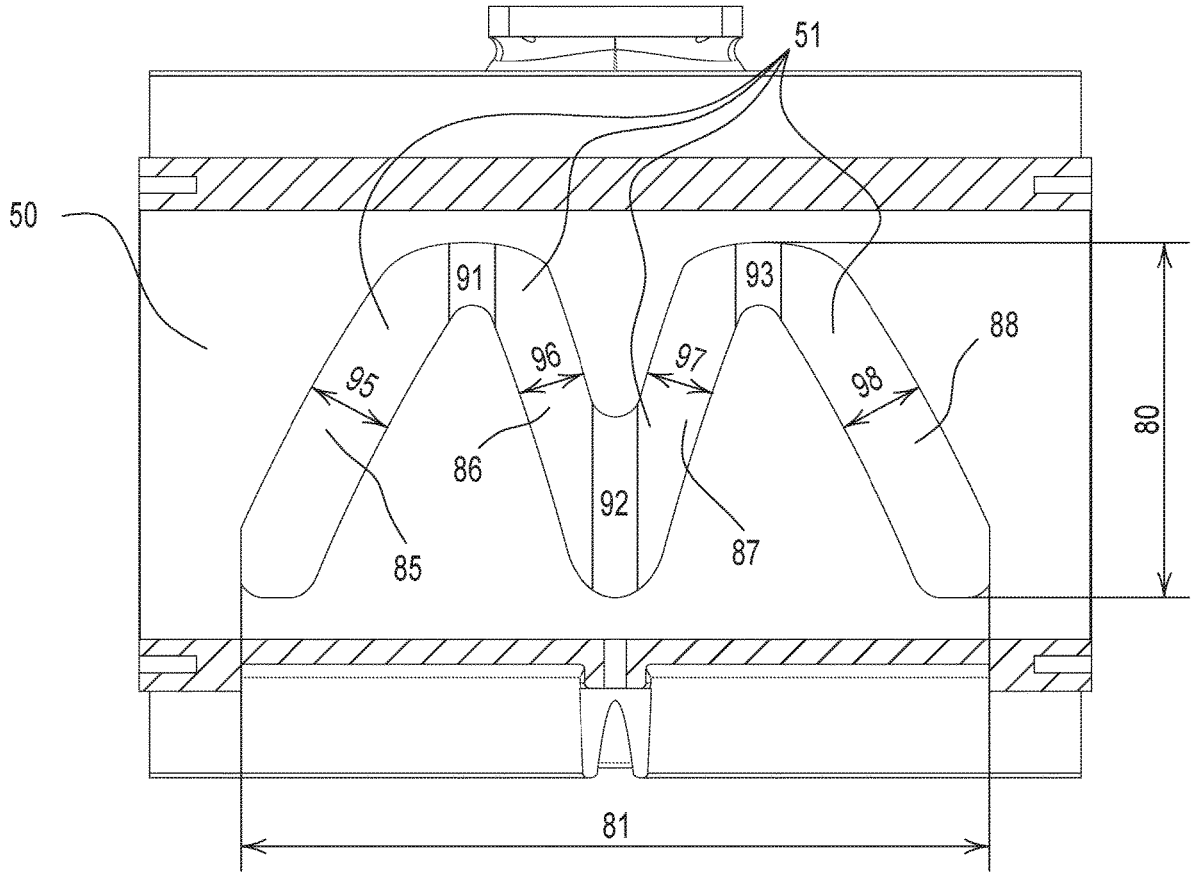
FIG. 6 illustrates a preferred embodiment of the invention and provides descriptions used in describing the invention.

FIG. 6 is the preferred embodiment of the invention as in FIG. 2. The invention comprises an opening 51 in the stator 50 the said opening in turn comprising four channel legs 85, 86, 87 and 88 each of the said channel legs having a width of 95, 96, 97 and 98 respectively. The transition between each of the said channel legs when joined with another channel leg also has a rib 91, 92 and 93. The height 80 and width 81 of the said opening can be described as well as the total area of the opening.

The invention claimed is:

1. A rotary vane vacuum pump comprising:

a rotor eccentrically mounted within a stator to create a compression zone;

at least two vanes slidably mounted in the rotor which compress and discharge a gas;

where the gas is introduced into the compression zone through an inlet port opening in the stator;

and the gas after compression by rotation of the rotor is discharged through an outlet port opening in the stator;

wherein the inlet port opening comprises two or more diagonally positioned channel legs intersecting one another and extending along an inner circumferential surface of the stator.

2. The rotary vane vacuum pump of claim 1 wherein the two or more channel legs intersect at an acute point, and a rib is placed at the acute point.

3. The rotary vane vacuum pump of claim 2 wherein the rib prevents a leading edge of the at least two vanes from interacting with the acute point.

4. The rotary vane vacuum pump of claim 1 wherein the two or more channel legs define an inverted V.

5. The device rotary vane vacuum pump of claim 1 wherein the two or more channel legs define an upright V.

6. The rotary vane vacuum pump of claim 1 wherein the two or more channel legs define one of an upright W and an inverted W.

7. The rotary vane vacuum pump of claim 1 wherein the two or more channel legs are disposed in a zig-zag fashion with respect to each other.

8. The rotary vane vacuum pump of claim 1 wherein the two or more channel legs have a different width.

9. The rotary vane vacuum pump of claim 1 wherein the two or more channel legs have a different length.

10. The rotary vane vacuum pump of claim 1 wherein the at least two vanes engage the inner circumferential surface of the stator.

11. A rotary vane vacuum pump comprising:

a rotor eccentrically mounted within a stator to create a compression zone;

at least two vanes slidably mounted in the rotor which compress and discharge a gas;

where the gas is introduced into the compression zone through an inlet port opening in the stator;

and the gas after compression by rotation of the rotor is discharged through an outlet port opening in the stator;

wherein the inlet port opening comprises two or more diagonally positioned channel legs where each of the channel legs is disposed in a zig-zag fashion with respect to each other; and wherein the channel legs define one of an inverted W and an upright W.

12. A rotary vane vacuum pump comprising:

a rotor eccentrically mounted within a stator to create a compression zone;

at least two vanes slidably mounted in the rotor which compress and discharge a gas;

where the gas is introduced into the compression zone through an inlet port opening in the stator;

and the gas after compression by rotation of the rotor is discharged through an outlet port opening in the stator;

wherein the inlet port opening comprises two or more diagonally positioned channel legs where each of the channel legs is disposed in a zig-zag fashion with respect to each other; and wherein each of the channel legs has a different width and length chosen and disposed in a fashion chosen to maximize the area of the inlet port opening.

* * * * *